US005678477A

United States Patent [19]

Satake et al.

[11] Patent Number: 5,678,477

[45] Date of Patent: Oct. 21, 1997

[54] HUSKING APPARATUS

[75] Inventors: Satoru Satake, Tokyo; Hiroyuki Fukumitsu, Higashihiroshima, both of Japan; Masaya Yamamoto, Wilmslow, England

[73] Assignee: Satake Corporation, Tokyo, Japan

[21] Appl. No.: 725,427

[22] Filed: Oct. 3, 1996

[30] Foreign Application Priority Data

Nov. 2, 1995 [JP] Japan ..... 7-309933

[51] Int. Cl.[6] ..... B02B 3/00; B02B 3/04; B02B 3/06; B02B 7/02

[52] U.S. Cl. ..... 99/519; 99/524; 99/600; 99/609; 99/617

[58] Field of Search ..... 99/485–488, 518–525, 99/528, 600–602, 605–608, 609, 612–615, 617, 620, 622, 628; 426/481–483; 241/57, 58, 49, 74, 257.1, 260.1, 7, 93

[56] References Cited

U.S. PATENT DOCUMENTS

| | | | |
|---|---|---|---|
| 4,829,893 | 5/1989 | Satake | 99/603 |
| 4,843,957 | 7/1989 | Satake | 99/519 |
| 4,896,592 | 1/1990 | Satake | 99/519 |
| 4,913,045 | 4/1990 | Satkae | 99/610 X |
| 5,033,371 | 7/1991 | Satake et al. | 99/600 X |
| 5,076,157 | 12/1991 | Satake | 99/524 X |
| 5,119,721 | 6/1992 | Satake et al. | 99/609 X |
| 5,295,629 | 3/1994 | Satake et al. | 241/57 |
| 5,390,589 | 2/1995 | Satake et al. | 99/613 X |
| 5,394,792 | 3/1995 | Satake et al. | 99/617 X |
| 5,413,034 | 5/1995 | Satake et al. | 99/519 |
| 5,419,252 | 5/1995 | Satake et al. | 99/524 X |
| 5,511,469 | 4/1996 | Satake et al. | 99/617 X |

FOREIGN PATENT DOCUMENTS

| | | |
|---|---|---|
| 27-5407 | 10/1926 | Japan . |
| 30-5826 | 6/1927 | Japan . |
| 30-17146 | 5/1928 | Japan . |
| 30-9112 | 6/1929 | Japan . |
| 31-17175 | 4/1930 | Japan . |
| 47-22131 | 7/1972 | Japan . |
| 50-57855 | 5/1975 | Japan . |
| 61-68144 | 4/1986 | Japan . |
| 61-174951 | 8/1986 | Japan . |
| 63-6050 | 1/1988 | Japan . |
| 569 519 | 11/1975 | Switzerland . |
| 2 054 346 | 2/1981 | United Kingdom . |
| 2 219 726 | 12/1989 | United Kingdom . |

*Primary Examiner*—Timothy F. Simone
*Attorney, Agent, or Firm*—Darby & Darby

[57] ABSTRACT

In a husking apparatus comprising: a husking portion having a pair of husking rolls which are adjustable in clearance between them and rotated in opposite directions with different peripheral speeds to perform husking of paddy grain; and a supply portion disposed above the husking portion for supplying paddy grain to be husked to the husking portion, wherein the supply portion is so constructed as to supply paddy grain from the supply portion to the husking portion in the form of a layer in such a manner that a thickness of the layer of a flow of paddy grain becomes not greater than two grains at the husking portion, and the supply portion is so constructed as to supply paddy grain to the husking portion at a speed not less than a flowing-down speed corresponding to a minimum husking throughput desired of the husking apparatus so that husking is performed with a throughput not less than the minimum husking throughput, it is possible to enhance the husking throughput while minimizing the breakage of paddy grain. In cases where paddy is the one of long-grain variety of rice, the flowing-down speed of paddy grain is set to be not less than 3 m/sec when the paddy grain reaches a region around the clearance between the pair of husking rolls.

8 Claims, 6 Drawing Sheets

HUSKING APPARATUS

FIELD OF THE INVENTION

This invention relates to a husking or hulling apparatus for cereal grain, and more specifically to a husking apparatus comprising a roll type husking portion having a pair of husking rolls which are adjustable in clearance between them and rotated in opposite directions with different peripheral speeds to perform husking of paddy grain, and a supply portion disposed above the husking portion for supplying paddy grain to be husked to the husking portion, which apparatus is particularly suitable to the husking of such cereal grain that is easy to break to become broken grain with an impact as long-grain species or variety of cereal grain. Herein, the term "long-grain species (or variety)" of cereal grain is referred to as a cereal grain having a ratio of its length to width (length along major axis in cross-section of the grain) not less than 2.

BACKGROUND ART

Long-grain species or variety of cereal grain is liable to be broken because of its thin and long shape, and therefore the percentage of broken grain is liable to be higher in case of husking long-grain variety of cereal grain than in case of husking other variety of cereal grain than long-grain variety. Particularly, enhancement of a husking throughput (the weight of cereal grain that can be husked per unit time) of the husking apparatus causes the percentage of broken grain contained in the husked cereal grain to increase to deteriorate the yield of regular grain.

For this reason, heretofore, the higher it has been intended to increase the yield of regular grain, the lower the throughput of the husking apparatus should have been deteriorated in performing the husking process.

In a husking apparatus having rubber rolls ten inches long as husking rolls, it is said that the throughput thereof is 5 ton/hour, i.e. 5,000 kg/hour, in case of husking cereal grain of a species or variety other than long-grain variety (referred to hereafter also as "not-long-grain species or variety"). However, according to the conventional husking apparatus, in cases where husking of long-grain variety of cereal grain was intended to be performed under the same conditions as the husking of not-long-grain variety of cereal grain, the rate at which cereal grain was broken has become too high.

Accordingly, in case of husking the long-grain variety of cereal grain with the conventional husking apparatus, it has been customary to perform the husking process with reduced flow rate of supply (amount of supply per unit time) or throughput.

However, in cases where the husking apparatus was combined with a milling machine for removing bran from husked cereal grain and the like to form a milling unit, reduction in the throughput of the husking apparatus resulted in deterioration of the overall throughput of the milling unit including the husking apparatus. On the other hand, in order to keep the overall throughput of the milling unit at a predetermined level, there has been needed wasteful investment in plant and equipment such as addition of husking apparatus.

Japanese Patent Unexamined Publication No. 61-68144 discloses that, if the supply amount (per unit time) of paddy to a roll type husking potion is too much in a roll type husking apparatus, paddy stagnates on a pair of husking rolls of the husking portion to cause broken grain to be easily produced or generated, and the paddy grain passes through between the rolls with the axis thereof parallel to surfaces of the rolls so that it is difficult to perform the husking satisfactorily. Further, Japanese Patent Unexamined Publication No. 61-68144 additionally discloses that, in order to increase the husking rate while suppressing the production of broken grain, the paddy grain is supplied in between the rolls by means of through holes extending in the vertical direction so that the axis of paddy grain is made perpendicular to the (horizontal) axes of the rolls and parallel to the direction in which the paddy grain falls.

Japanese Patent Unexamined Publication No. 61- 174951 that, if the supply amount (per unit time) of paddy to a roll type husking portion is too much in a roll type husking apparatus, paddy grain piles up on a pair of husking rolls of the husking potion to turn and fall down horizontally so that it is highly likely to come in contact with rotating roll surfaces to be broken, thereby causing broken grain to be easily produced or generated, while if the supply amount (per unit time) of paddy grain is too small, the husking efficiency (the amount of paddy that can be husked per unit time) is lowered. Further, Japanese Patent Unexamined Publication No. 61-174951 discloses that as the clearance or gap between the pair of husking rolls is made narrower, the husking rate (the percentage of paddy grain husked to a desired level among the paddy grainpassed through between the husking rolls) becomes higher but the percentage of broken grain is increased, while as the clearance between the rolls is widened, the husking rate is deteriorated to increase the percentage of unhusked grain (paddy grain that is not husked to the desired level). In addition, Japanese Patent Unexamined Publication No. 61-174951 discloses that the length of a discharge port (paddy grain supply port) formed in a bottom surface of a feed funnel as a paddy grain feed tank is made equal to the length of the husking rolls and the width of the discharge port is made equal to the thickness (length in the direction of minor axis) of paddy grain so that the paddy grain can be dropped and supplied vertically onto the whole length of the rolls successively.

It is also disclosed in Japanese Utility Model Unexamined Publication No. 63-6050, Japanese Utility Model Examined Publication Nos. 31-17175 and 30-5826 etc., for example, that paddy grain is put in lines or aligned in the vertical direction in order that husk can be easily removed from paddy grain to improve the husking rate. Japanese Utility Model Unexamined Publication No. 63-6050 discloses that a large number of vertical passages, which are parallel to each other and guide the paddy grain, are formed between a pair of rectifying plates provided between a pair of feed rolls disposed immediately below a paddy grain supply port and a pair of husking rolls located below the pair of feed rolls. Japanese Utility Model Examined Publication No. 31-17175 discloses that a large number of parallel vertical grooves or passages for guiding paddy grain are formed between a pair of endless belts provided between a paddy feed funnel as a paddy feed tank and a pair of husking rolls. Japanese Utility Model Examined Publication No. 30-5826 discloses that a chute for guiding the supply of paddy grain fed from the bottom of a paddy feed funnel to a roll type husking portion by virtue of air stream is formed with a large number of guide grooves extending in the longitudinal direction of the chute.

It is also disclosed in Japanese Patent Unexamined Publication No. 50-57855 that paddy grain is put in lines, i.e. aligned, in the vertical direction. Japanese Patent Unexamined Publication No. 50-57855 discloses that a chute extending between a paddy feed funnel and a pair of husking rolls is formed with a large number of parallel vertical grooves for guiding paddy grain.

Incidentally, in the prior arts such as Japanese Patent Unexamined Publication Nos. 61-68144 and 61-174951, Japanese Utility Model Unexamined Publication No. 63-6050, Japanese Patent Unexamined Publication No. 50-57855 and Japanese Utility Model Examined Publication No. 30-5826, it is disclosed that when paddy grain is sent to the roll type husking portion along the vertical grooves, passages or through holes, the portion in which the grooves, passages or through holes are formed is caused to vibrate.

Japanese Patent Examined Publication No. 27-5407 discloses that positions of a pair of paddy feed rolls and a pair of husking rolls are controlled by a link mechanism in such a manner that the clearance between the pair of husking rolls is aligned in the vertical direction with the clearance between the pair of paddy feed rolls disposed immediately below a feed funnel as the paddy feed tank regardless of factors such as the degree of progress of abrasion of the husking rolls. Incidentally, Japanese Patent Examined Publication No. 27-5407 discloses that the peripheral speed of the paddy feed rolls is made lower than the peripheral speeds of the husking rolls in order to prevent paddy grain from piling up on or above the clearance between the pair of husking rolls.

Japanese Utility Model Examined Publication No. 47-22131 discloses that a distance between a pair of guide plates for guiding the flow of paddy grain to the clearance between a pair of husking rolls is made narrower as getting closer to the pair of husking rolls, and a negative pressure condition is formed in the vicinity of the clearance between the pair of husking rolls, so that paddy grain is positively sucked into the clearance between the pair of husking rolls.

SUMMARY OF THE INVENTION

Surprisingly, inventors have experimentally found out that in cases where paddy grain is supplied from a paddy grain supply portion to a husking portion in the form of a layer in such a manner that a thickness of the flow of paddy grain becomes not greater than two grains at the husking portion, even if a husking speed in the husking portion is extremely increased, it is possible to minimize the breakage of grain even in the case of such cereal grain that is easy to break as long-grain variety or species of grain.

The present invention has been developed to eliminate at least part of the above-described problems on the basis of the new finding described just above, and an object of the invention is to provide a husking apparatus which is capable of increasing a husking throughput while minimizing the breakage of paddy grain.

According to the present invention, the above object is achieved by a husking apparatus comprising: a husking portion having a pair of husking rolls which are adjustable in clearance between them and rotated in opposite directions with different peripheral speeds to perform husking of paddy grain; and a supply portion disposed above the husking portion for supplying paddy grain to be husked to the husking portion, wherein the supply portion is so constructed as to supply paddy grain from the supply portion to the husking portion in the form of a layer in such a manner that a thickness of the flow layer of paddy grain becomes not greater than two grains at the husking portion, and the supply portion is so constructed as to supply paddy grain to the husking portion at a speed not less than a flowing-down speed corresponding to a minimum husking throughput desired of the husking apparatus so that husking is performed with a throughput not less than the minimum husking throughput.

The minimum husking throughput is referred to, herein, as a throughput required for the conventional husking apparatus upon husking the paddy grain of not-long-species or variety.

In cases where paddy is the one of long-grain variety of rice grain, the apparatus is preferably designed such that the flowing-down speed of paddy grain becomes not less than 3 m/sec when the paddy grain reaches the clearance or gap between the pair of husking rolls.

In the husking apparatus according to the invention, the supply portion for supplying paddy grain to be husked to the husking portion is so constructed or designed as to supply paddy grain from the supply portion to the husking portion in the form of a layer or thin and wide laminar flow so that the thickness of the flow of paddy grain becomes not greater than two grains on arriving at the pair of husking rolls of the husking portion, and therefore it is possible to minimize the apprehension about breakage of paddy grain due to the pressure between elastic rolls such as rubber rolls. It is therefore possible to minimize the fear of breakage of paddy in the husking portion even if paddy is the one of long-grain variety of rice. Further, in the husking apparatus of the invention, the supply portion is so constructed or designed as to supply paddy grain to the husking portion at a speed not less than a flowing-down speed corresponding to a minimum husking throughput desired of the husking apparatus (approximately equal to 3 m/sec in practice in the case of paddy of long-grain variety) so that husking is performed with a throughput not less than the minimum husking throughput, and therefore even if the layer thickness of the flow of paddy grain is reduced to not greater than two grains, the husking throughput can be maintained at a predetermined level.

More specifically, in the husking apparatus of the invention, since the flowing-down speed or the supplying speed of the flow of paddy grain is increased at least by an amount corresponding to the decrement of the layer thickness of the flow of paddy grain, the husking throughput of the apparatus never be deteriorated as a whole, and since the layer thickness of the flow of paddy grain is made thinner, it is possible to minimize the generation of broken grain between the elastic rolls. Incidentally, the fact that "in cases where paddy grain is supplied from a paddy grain supply portion to a husking portion in the form of a layer in such a manner that a thickness of the layer of the flow of paddy grain becomes not greater than two grains at the husking portion, even if a husking speed in the husking portion is increased extremely high, it is possible to minimize the breakage of grain even in the case of such cereal grain that is easy to break as long-grain variety" has been found out experimentally or in test by the inventors. The inventors have experimentally found out the upper limit in layer thickness from the relationship experimentally obtained about throughput and yield or percentage of broken grain as described later in detail with reference to FIG. 5, and completed the invention on the basis of this new findings.

In accordance with a preferred embodiment of the invention, the husking apparatus described above is constructed, more concretely, such that the supply portion comprises a feed tank for storing paddy grain, a guide chute mechanism for sending paddy grain from a lower end thereof to the husking portion, the guide chute mechanism having a guide chute on which paddy grain slides down, and a feed portion for guiding the paddy grain falling from an outlet of the feed tank to an upper end of the guide chute in order, a fall or vertical distance from the outlet of the feed tank to the clearance between the husking rolls of the husking portion being not less than 500 mm, and the guide chute being so constructed that a thickness of the layer of the flow of paddy grain thrown out of the lower end of the chute becomes not greater than two grains.

In this embodiment, it has experimentally been confirmed that if the fall or vertical distance from the outlet of the feed tank to the clearance between the husking rolls of the husking portion is not less than 500 mm, paddy grain sliding down along the guide chute under the action of gravity gains a speed not less than 3 m/sec on arriving at a region around the clearance between the pair of husking rolls. Therefore, in this case, paddy grain introduced through the guide chute to the pair of husking rolls in such a manner that the thickness of the layer of the flow of paddy grain thrown out from the lower end of the guide chute becomes not greater than two grains, can gain a flowing-down speed not less than a speed required of the husking apparatus even if paddy grain is the one of long-grain variety. For this reason, in a husking apparatus provided with a husking roll portion comprising a pair of rolls whose effective husking length is 10 inches, for example, it is possible to achieve a throughput of 5 ton/hour while minimizing the production of broken grain.

In the husking apparatus according to a preferred embodiment of the invention, an adjusting mechanism is provided for adjusting an inclination of the guide chute to regulate or adjust a position of the lower end of the chute in response to a change in the position of the clearance between the husking rolls attributed to progress of abrasion of the rolls.

In accordance with another preferred embodiment of the invention, the husking apparatus described above is constructed, more concretely, such that the supply portion comprises a feed tank for storing paddy grain, an accelerating mechanism portion for positively or actively accelerating paddy grain having been dropped from an outlet of the feed tank, and a guide mechanism portion for guiding the fall of paddy grain having been accelerated by the accelerating mechanism portion to sent the paddy grain to the husking portion, the accelerating mechanism portion and the guide mechanism portion are so constructed that a thickness of a layer of the flow of paddy grain, thrown out from a lower end of the guide mechanism portion to be sent to the husking portion in the form of the layer, becomes not greater than two grains at the husking portion, and the supply portion is so constructed as to supply paddy grain to the husking portion at a speed not less than a flowing-down speed corresponding to a minimum husking throughput desired of the husking apparatus so that husking is performed with a throughput not less than the minimum husking throughput.

In this embodiment, in cases where paddy is the one of long-grain variety of rice, the supply portion including the accelerating mechanism portion and the guide mechanism portion accelerates paddy grain so that a flowing-down speed of not less than 3 m/sec is achieved, for example. Preferably, the accelerating mechanism is constituted by a pair of constant-speed rotary rolls by which paddy grain is nipped and thrown out. As for the accelerating mechanism, the roll type accelerating mechanism may be replaced by any other appropriate accelerating means such as a belt type accelerating mechanism or a thrower type accelerating mechanism. Meanwhile, the guide mechanism is so constructed that the thickness of the layer of the flow of paddy grain, having been thrown out from the lower end of the guide mechanism portion to be sent to the husking portion in the form of the layer, becomes not greater than two grains at the husking portion. Therefore, in the husking apparatus of this embodiment as well, it is possible to achieve a desired husking throughput while minimizing the generation of broken grain even in the case of paddy of long-grain variety. Incidentally, the guide mechanism comprises a delivery or feed-out mechanism having guide plates which are so arranged as to get closer to each other as going to their lower ends, for example. As for the guide mechanism, the delivery mechanism may be replaced by other appropriate mechanism such as electromagnetic or conveyer-type or other feeder utilized in a color sorting apparatus for sorting cereal grain according to its color.

Referring more concretely to the flowing-down speed of paddy grain, it is as follows. For instance, a husking throughput of 5 ton/hour is generally achieved with elastic rolls whose effective husking length is 10 inches (about 0.25 m). A thickness of the layer of the flow of paddy grain is about 0.003 m provided that the layer contains two paddy grains in the direction of thickness thereof. Therefore, assuming that the flowing-down speed of paddy grain is V m/sec, the volumetric flow rate (per unit time) of the flow of paddy grain is 0.00075 V $m^3$/sec which corresponds to a mass flow rate (per unit time) of 5 ton/hour. Accordingly, it will do that the rotational speed of the constant-speed rotary roll and the like may be decided so that the flowing-down speed of the flow of paddy grain becomes $V=(5/0.00075)/3600d$ (where "d" represents bulk specific gravity of the layer of the flow of paddy grain measured in the unit of ton/$m^3$). Under normal or ordinary conditions, the flowing-down speed V obtained in this manner will be about 3 m/sec.

The foregoing and other object, features and advantages of the invention will be made clearer hereafter from the description of preferred embodiments referring to the attached drawings.

DETAILED DESCRIPTION OF PREFERRED EMBODIMENTS

Description will be given of a husking or hulling apparatus according to a first preferred embodiment of the present invention with reference FIGS. 1, 1A and 2. This husking apparatus can perform a husking operation, at a throughput of 5 ton/hour, of paddy of long-grain variety of rice.

Figure 1:
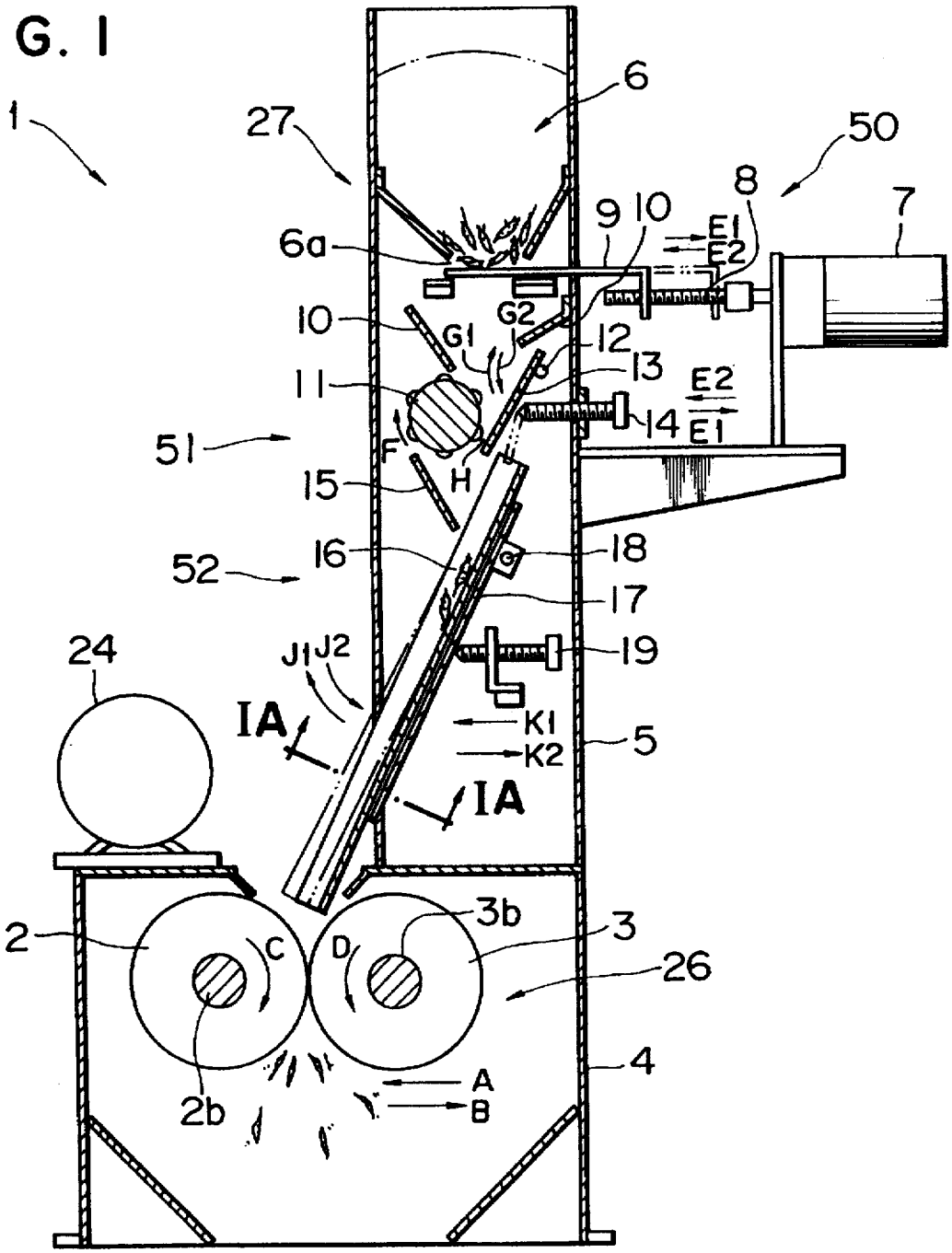
FIG. 1 is a vertical sectional view of a husking or hulling apparatus according to a first embodiment of the invention.
Figure 1A:
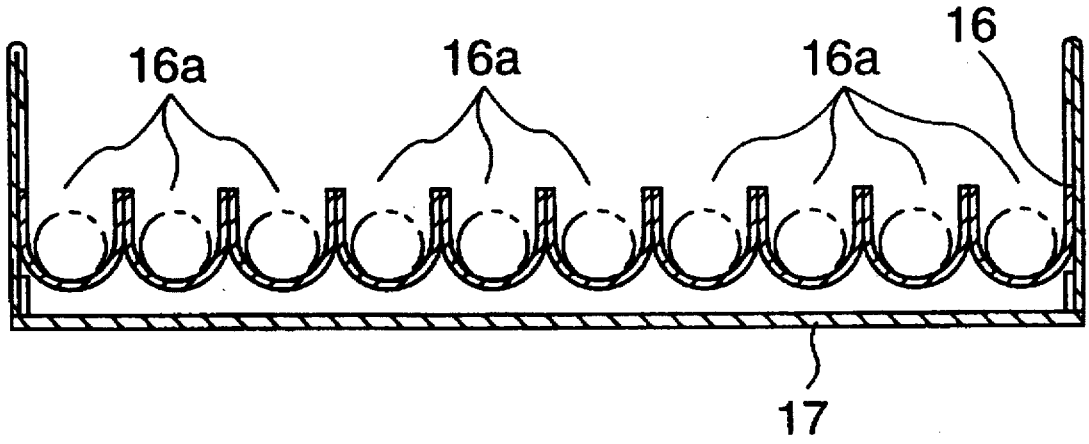
FIG. 1A is a cross-sectional view of a guide chute of the apparatus of FIG. 1 along a line IA—IA.

FIG. 1 is a general sectional view of a husking apparatus 1. A pair of rubber rolls 2, 3 are rotatably supported in a lower part of a machine frame 4 of the husking apparatus 1 for serving as a pair of husking rolls. The rubber rolls 2, 3 as elastic rolls each have an axial effective husking length of 10 inches, for example. Distance between central shafts of rotation 2*b*, 3*b* of the rubber rolls 2, 3 is adjustable. It can be adjusted by a roll position adjusting mechanism which may be any conventional appropriate mechanism (not shown), for example. By moving the shaft 3b of rubber roll 3 close to and away from the shaft 2b of the rubber roll 2 in the direction A or B, size or magnitude of a gap or clearance (not shown) between peripheral surfaces of the rubber rolls 2, 3 can be adjusted. The shaft 2b may be made adjustable or movable in position in the directions A, B instead of the shaft 3b, or both the shafts 2b, 3b may be made adjustable or movable in position in the directions A, B. As shown in FIG. 2, a pulley 2a is fixed on the shaft 2b of the rubber roll 2 in coaxial relation to the rubber roll 2, while a pulley 3a having a smaller diameter than the pulley 2a is fixed on the shaft 3b of the rubber roll 3 in coaxial relation to the rubber roll 3, these pulleys 2a, 3a being rotated in opposite directions C, D with different angular velocities or rotation speed (turns/unit time) by means of belts 29, 30 as described later. Accordingly, the rubber rolls 2, 3 of the same diameter form a husking roll portion or a husking rubber roll device 26 as the husking portion in which the rolls 2, 3 are rotated in opposite directions C, D with different peripheral speeds to perform husking operation.

Before describing the details of the husking apparatus 1, test result, i.e. experimental result, obtained by the inventors, on which the invention is based, will now be described.

Figure 5:
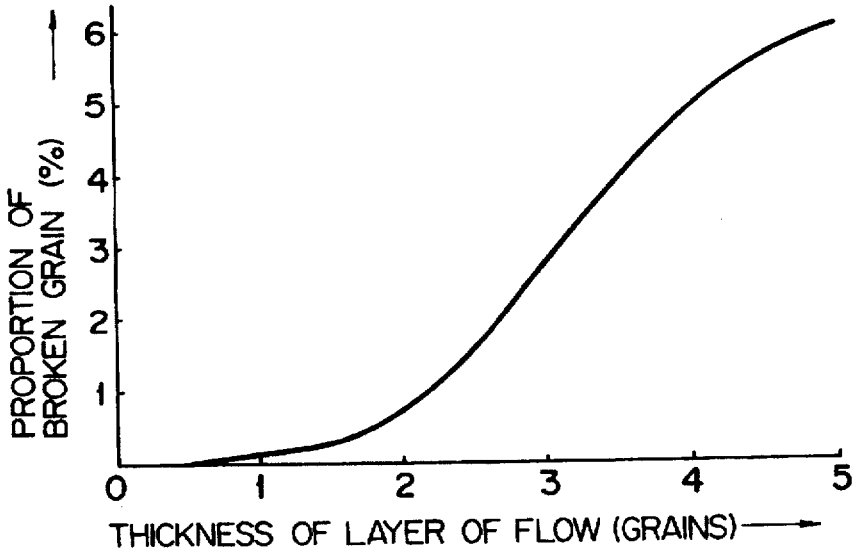
FIG. 5 is a graph showing relationship of percentage of broken grain with respect to thickness of layer of flow of paddy of long-grain variety or species.

In FIG. 5 showing the test result obtained by the inventors, taken as the abscissa is the thickness of the layer of the flow of paddy of long-grain variety of rice when the paddy grain flows in between the pair of husking rolls 2, 3 of the husking portion 26, which is expressed in the unit of the number of grains, while taken as the ordinate is the proportion of broken grain contained in the long-grain variety of rice discharged from the husking portion 26, which is expressed as a percentage. Incidentally, the similar test was performed to have data of the husking rate or percentage as well.

As is apparent from a graph or a curve in FIG. 5, as the layer thickness of the flow of long-grain variety of rice becomes not less than four grains, the percentage (proportion) of broken grain becomes greater than 5%, and therefore the yield of regular, i.e. not-broken, grain is considerably lowered. The inventors suppose or assume that this is attributed to the fact that, in case of a large layer thickness, paddy of long-grain variety of rice is caused to lie one upon another crosswise, for example, between the rubber rolls 2, 3 and applied with pressures of the rubber rolls 2, 3 and force resulting from difference speeds of the rolls 2, 3 to be broken. On the other hand, as the layer thickness of the flow of long-grain variety of rice becomes smaller to approach two grains, the percentage (proportion) of broken grain is sharply reduced down to less than 1%. The present inventors have experimentally confirmed that the characteristics of FIG. 5 could be obtained regardless of flowing speed of the paddy of long-grain variety of rice.

It has also been experimentally confirmed that even other variety of paddy than long-grain variety has exhibited basically the same characteristics (though a change in the percentage of broken grain was not so remarkably dependent on the thickness of the layer of the flow as compared with the case of paddy of long-grain variety of rice). In consequence, the invention shows the advantages thereof most conspicuously in case of being applied to the paddy of long-grain variety, but it is effective even in case of husking other variety of paddy than long-grain variety, i.e. not-long grain variety or species.

In the invention, based on this test result, supply mechanism is so adjusted as to make the layer thickness not greater than two grains and the flowing-down speed of the flow of paddy grain is increased lest the throughput as a husking apparatus should be deteriorated.

Referring back to FIG. 1, in an upper part of the machine frame 4, that is, in the vicinity of the uppermost portion of an upper machine frame 5, a feed tank 6 for storing paddy grain is provided. The feed tank 6 has its lower portion formed in a generally funnel shape. At the lower end of the feed tank 6 is formed an opening 6a through which paddy grain is discharged or supplied.

Immediately below the opening 6a of the feed tank 6 is provided a shutter 9 which is screw-fitted at a base thereof around a bolt 8 fixed to an output shaft of a small-scale motor 7 mounted on the upper machine frame 5 and displaced by the motor 7 in the directions E1 and E2 to open and close the opening 6a of the feed tank 6. The small-scale motor 7, the bolt 8 and the shutter 9 cooperate with each other to form an opening and closing mechanism 50 for the feed tank 6. The opening and closing mechanism 50 for the tank 6 may be of any other structure so far as it can adjust the size of the feed port 6a.

Below the shutter 9 are provided inclined guide plates 10, a feed or delivery roll 11 located below the guide plates 10 and provided with projections on a peripheral surface thereof and rotated constantly in a direction F so as to send paddy grain downward, and an adjusting plate 13 rotatable or pivotal about a pivot shaft 12 in the directions G1 and G2. The adjusting plate 13 is supported at a lower portion thereof, i.e. at a portion lower than a pivotally supported portion, by a bolt 14 screwed through an internally threaded screw portion of the upper machine frame 5. The bolt 14 is moved in the directions E2, E1 to cause the adjusting plate 13 to rotate about the pivot shaft 12 in the directions G1, G2, so that a gap H between the adjusting plate 13 and the delivery roll 11 is adjusted or set appropriately. Difference in height (fall) between a position of the gap H and a position of the clearance between the rubber rolls 2, 3 is made not smaller than 500 mm. The delivery roll 11, the adjusting plate 13 and the bolt 14 cooperate with each other to form a feed portion or mechanism 51 for feeding paddy grain at a desired fixed flow rate. The feed portion 51 may be of any other structure so far as it can send, at adjusted flow rate, the paddy grain coming out of the tank 6, toward the husking portion 26.

Below the delivery roll 11 is provided a guide chute 16, which is formed with longitudinally extending grooves or passages 16a in an upper conveying surface thereof (see FIG. 1A), in order to send the paddy grain passed through the gap H to the rubber roll device 26 as husking portion. Reference numeral 15 denotes a guide plate. The guide chute 16 is fixed to a chute frame 17 which is attached to the upper machine frame 5 so as to be pivotal about a pivot shaft 18 in the directions J1, J2. The chute frame 17 is supported at a lower portion thereof, i.e. at a portion lower than a pivotally supported portion, by a bolt 19 screwed through an internally threaded portion of the upper machine frame 5. The bolt 19 is moved in the directions K1, K2 to cause the chute frame 17 to rotate about the pivot shaft 18 in the directions J1, J2, so that inclination of the guide chute 16 is adjusted. A guide mechanism 52 is constituted by the guide plate 15, the guide chute 16, the chute frame 17, the rotary shaft 18 and the bolt 19. Adjustment of inclination of the guide chute 16 may be performed by any other mechanism so far as the inclination of the guide chute 16 can be adjusted.

As described above, a supply mechanism 27 is constituted by the feed tank 6, the opening and closing mechanism 50, the feed mechanism 51 and the guide mechanism 52.

Figure 2:
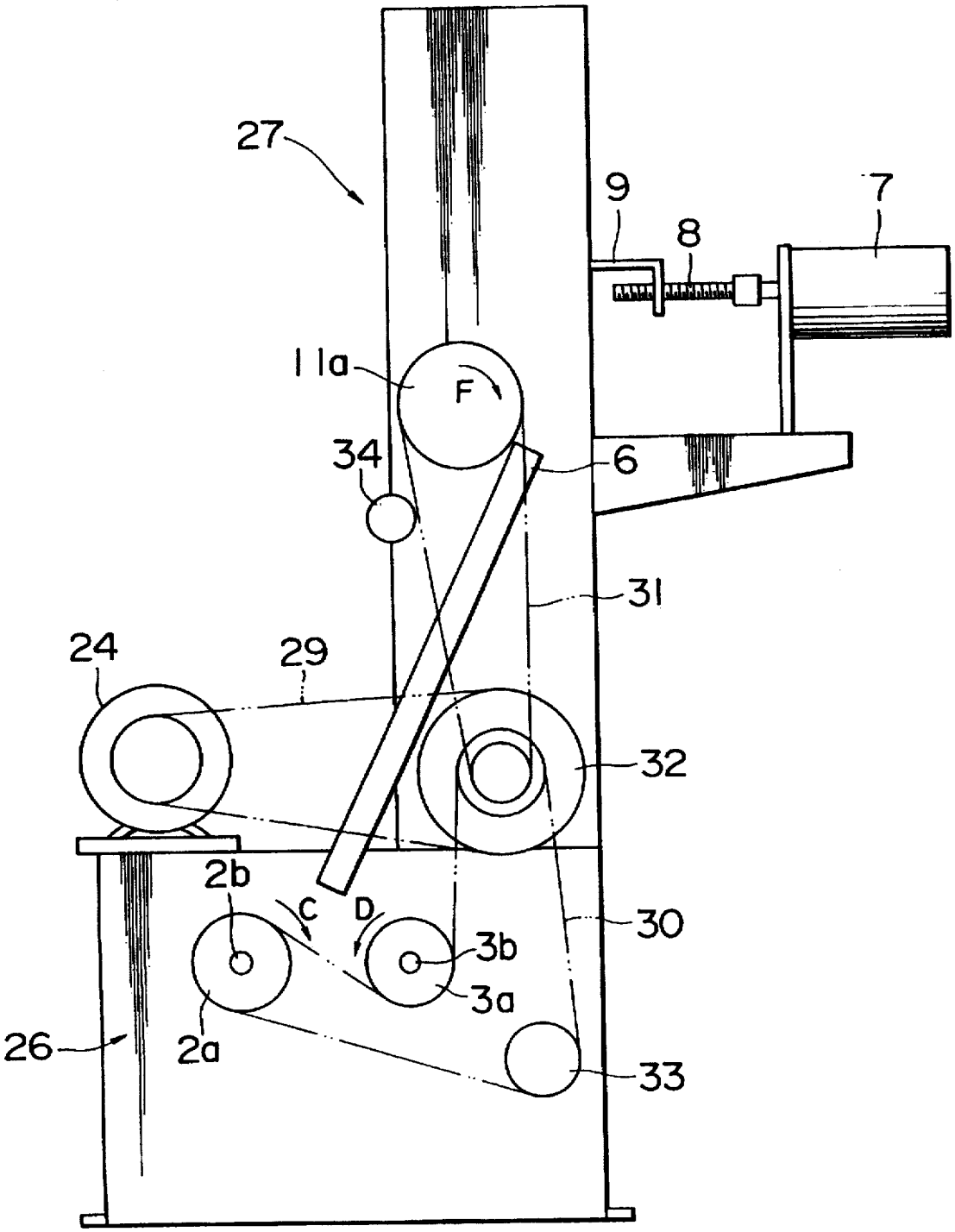
FIG. 2 is a schematic diagram of driving system for the apparatus of FIG. 1.

FIG. 2 shows the details of a driving system for the husking apparatus 1. Referring to an illustration of the driving system of FIG. 2, driving force of a main drive motor 24 is transmitted through a belt 29 and an intermediate pulley 32 to the husking portion or the rubber roll device 26 by means of a belt 30 on the one hand and to a pulley 11*a*, which is coaxial with the delivery roll 11 of the supply device 27, by means of a belt 31 on the other. Reference numerals 33, 34 denote tension pulleys.

The husking apparatus 1 thus constructed can achieve a throughput of not less than 5 ton/hour in husking operation.

In the husking apparatus 1 constructed as described above, when the main motor 24 is driven to rotate, the rubber rolls 2, 3 of the husking portion 26 and the delivery roll 11 of the feed portion 51 are driven to rotate in the predetermined directions. On the other hand, when the small-scale motor 7 is driven to cause the shutter 9 to open, paddy of long-grain variety of rice starts falling from the opening 6*a* of the feed tank 6 to be supplied to the delivery roll 11 by means of the guide plates 10 and then begins to be sent or discharged downward through the gap H at a fixed flow rate defined by the size or magnitude of the gap H between the delivery roll 11 and the adjusting plate 13 and the rotational speed of the delivery roll 11. The amount discharged or supplied (per unit time) is regulated or adjusted so that the thickness of the layer of the flow of paddy of long-grain variety of rice becomes not greater than two grains at the position between the rubber rolls 2, 3 at a flowing-down speed of the paddy grain to be described later.

The paddy of long-grain variety of rice, which has been discharged, is supplied to the guide chute 16 by means of the guide plate 15 to slide down thereon throughout a fall or vertical distance of 500 mm while being accelerated by the action of gravity. As a result, when the paddy grain finally arrives in between the rubber rolls 2, 3, the flowing-down speed V of paddy grain becomes not less than 3 m/sec. Consequently, the thickness of the layer of the flow of paddy of long-grain variety of rice becomes two grains as described above. In this way, the requirements for layer thickness and flowing-down speed, with which no broken grain may be produced or generated in practice, are satisfied, and therefore it is possible to secure a predetermined husking throughput for 10-inch rubber roll.

As described above, in the husking apparatus 1 according to the preferred embodiment of this invention, the layer thickness of the flow of paddy of long-grain variety of rice is made thinner than that adopted in recent years on the one hand and the flowing-down speed is increased to compensate the decrement in layer thickness on the other, and therefore it is ensured that husking process can be performed at a predetermined throughput estimated from the size (effective length) of rubber roll while minimizing the production or generation of broken grain in the husking process. In consequence, even in case of incorporation into a rice milling unit or line, there is no need to add the husking apparatus solely only for processing long-grain variety of rice or the like. Further, it becomes possible to design a throughput for the whole equipment on the basis of the predetermined throughput estimated from the size (effective length) of rubber roll.

It is unavoidable that the rubber rolls 2, 3, constituting the husking portion 26, is gradually abraded in their peripheral surfaces during husking operation. If at least either of the rubber rolls 2, 3 becomes worn, in order to keep the peripheral surface of the rubber roll 3 in a predetermined positional relation to the peripheral surface of the rubber roll 2, the rubber roll 3 is moved in the direction A to the rubber roll 2 as shown by phantom line in FIG. 6, for example. Due to this movement of the rubber roll 3, a contact portion between the rubber rolls 2, 3, corresponding to clearance or gap to be formed between the rubber rolls 2, 3 upon nipping the paddy grain while being elastically depressed due to elasticity of the rubber rolls 2, 3, is moved from L1 to L2. Therefore, a distal end or lower end 16*a* of the guide chute 16, which has originally been adjusted in position to face the position L1 of the contact portion between the rubber rolls 2, 3, should be adjusted so as to face the new position L2. In the example shown in FIG. 6, adjustment of the inclination of the guide chute 16 is performed automatically for the positional adjustment of the lower end 16*a* with respect to the contact portion.

Figure 6:
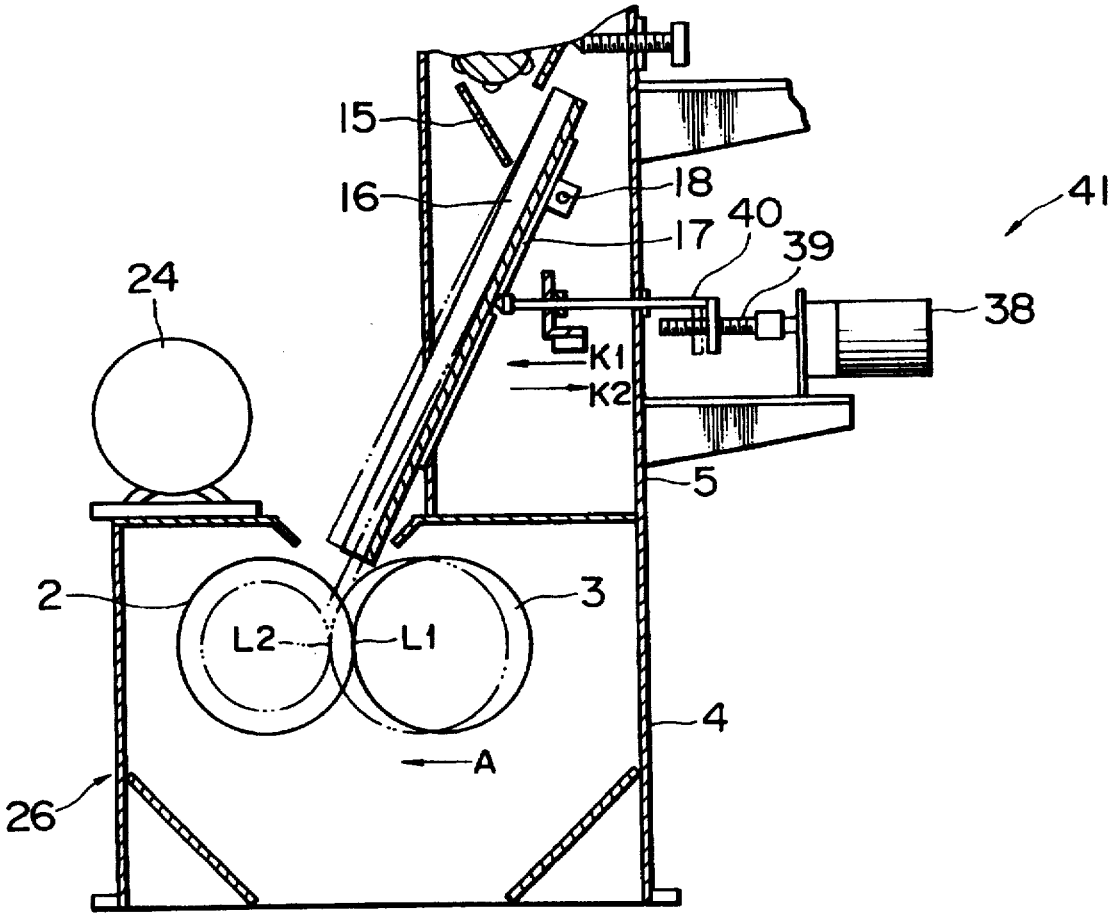
FIG. 6 is a schematic vertical sectional view of a device for adjusting an inclination of a guide chute.

Namely, in the example of FIG. 6, there is provided an adjusting device 41 in which a bolt 39 is fixed to an output shaft of a motor 38 mounted on the upper machine frame 5 and an adjusting bar 40 in threaded engagement with the bolt 39 is supported by the machine frame 5 so as to be slidable in the directions K1, K2.

In this case, the position L1 of the contact portion or point between the rubber rolls 2, 3 is detected by a sensor (not shown) and, in response to a position signal from the sensor, the inclination of the guide chute 16 is adjusted by the adjusting device 41, and therefore it becomes possible to operate continuously while maintaining the condition in which the husking throughput is enhanced. The sensor may be dispensed with in a case, for example, where the inclination of the chute 16 is adjusted by the adjusting device 41 according to a period of time when the husking portion 26 has been operated.

Now, description will be given of a husking or hulling apparatus according to a second preferred embodiment of the invention with reference to FIGS. 3 and 4. A husking apparatus 25 of the second embodiment is also provided with 10-inch husking rolls made of rubber and can achieve a throughput of 5 ton/hour like the husking apparatus 1 of the first embodiment.

Figure 3:
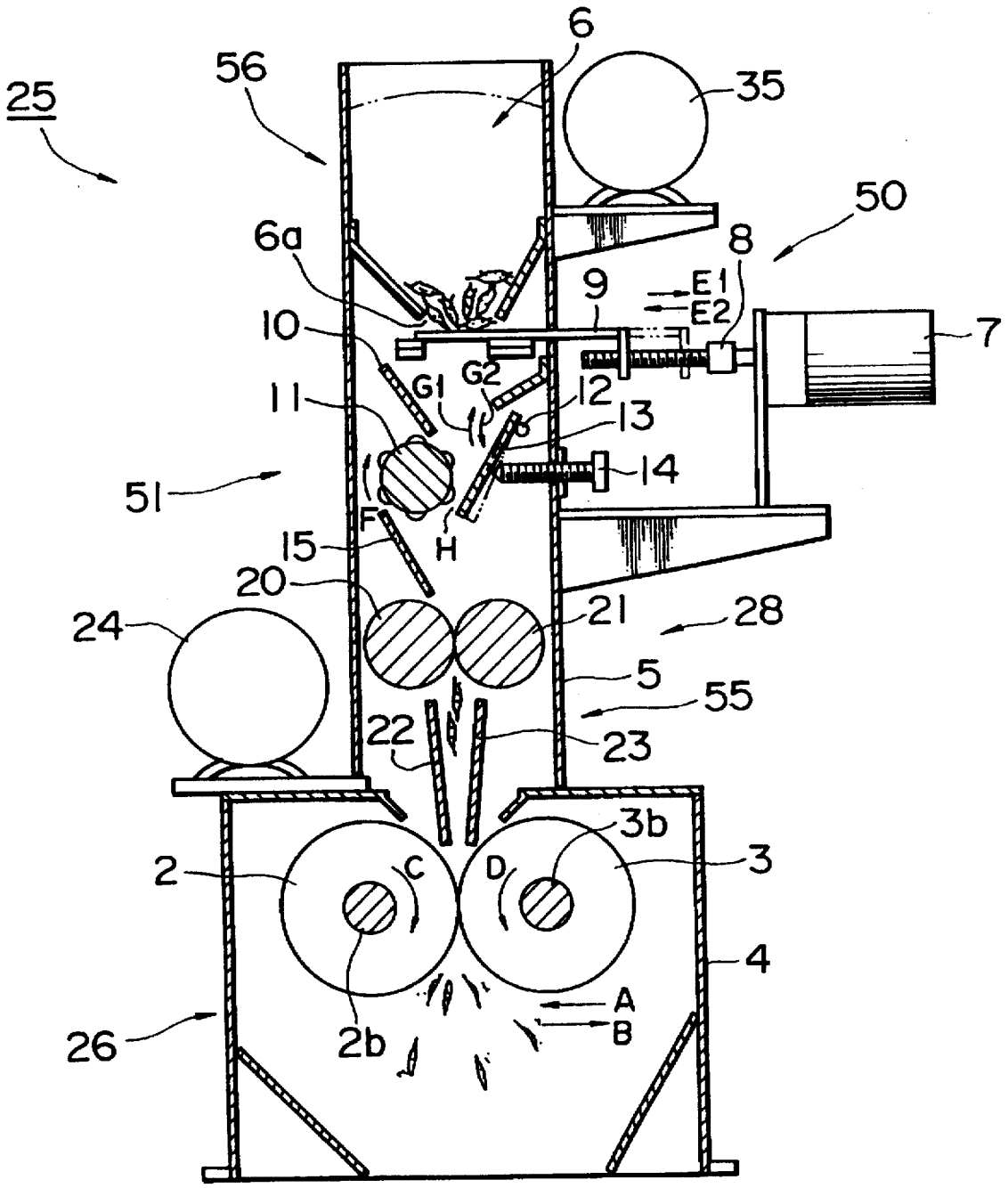
FIG. 3 is a vertical sectional view of a husking apparatus according to a second embodiment of the invention.

FIG. 3 shows a general sectional view of the husking apparatus 25 of the second embodiment, in which the same or similar components or members as those of the husking apparatus 1 of the first embodiment of FIG. 1 are designated by the same reference numerals. Similarly to the husking apparatus 1, a pair of rubber rolls 2, 3 as a pair of husking rolls are rotatably supported in a lower part of the machine frame 4 of the husking apparatus 25. Distance between central shafts of rotation 2*b* , 3*b* of the rubber rolls 2, 3 as elastic rolls is adjustable. As shown in FIG. 4, the pulley 2*a* is provided in coaxial relation to the rubber roll 2, while the pulley 3*a* having a smaller diameter than the pulley 2*a* is provided in coaxial relation to the rubber roll 3, these pulleys 2*a*, 3*a* being rotated in opposite directions C, D with different angular velocities by means of belts 29, 30. Accordingly, the rubber rolls 2, 3 of the same diameter form the husking roll portion or husking rubber roll device 26 as husking portion in which the rolls 2, 3 are rotated in opposite directions C, D with different angular velocities or peripheral speeds to perform husking operation.

In the upper part of the machine frame 4, that is, in the vicinity of the uppermost portion of the upper machine frame 5, the feed tank 6 for storing paddy grain is provided. The feed tank 6 has its lower portion formed in the generally funnel shape. At the lower end of the feed tank 6 is formed the opening 6*a* through which paddy grain is discharged or supplied.

Immediately below the opening 6a of the feed tank 6 is provided the shutter 9 which is screwed at the base thereof on the bolt 8 fixed to the output shaft of the small-scale motor 7 mounted on the upper machine frame 5 and is displaced or moved by the motor 7 in the directions E1 and E2 to open and close the opening 6a of the feed tank 6. The small-scale motor 7, the bolt 8 and the shutter 9 cooperate with each other to form the opening and closing mechanism 50 for the feed tank 6.

Below the shutter 9 are provided inclined guide plates 10, the feed or delivery roll 11 located below the guide plates 10 and provided with projections on a peripheral surface thereof and rotated constantly in the direction F so as to send paddy grain downward, and the adjusting plate 13 pivotal or rotatable about the rotary shaft or pivot 12 in the directions G1 and G2. The adjusting plate 13 is supported at the lower portion thereof by the bolt 14 screwed through the internally threaded portion of the upper machine frame 5. The bolt 14 is moved in the directions E2, E1 to cause the adjusting plate 13 to pivot or rotate about the pivot or rotary shaft 12 in the directions G1, G2, so that the gap H between the adjusting plate 13 and the delivery roll 11 is adjusted or set to the appropriate magnitude or width. The delivery roll 11, the adjusting plate 13 and the bolt 14 cooperate with each other to form the feed portion or mechanism 51 by means of which paddy grain is fed at the adjusted fixed flow rate.

Below the delivery roll 11 is provided a guide plate 15 and an accelerating mechanism or device 28 for sending the paddy grain, having come out of the gap H and guided by the guide plate 15, into the rubber roll device 26 as the husking portion at a speed of not less than a predetermined level. The accelerating mechanism 28 comprises a pair of rolls 20, 21 which are rotatably supported by the upper machine frame 5 in such a manner as to rotate in opposite directions with equal velocities. The rolls 20, 21 nip the paddy grain entering from above and throw it out downward at high speed after a short time to thereby accelerate the paddy grain.

The paddy grain having been accelerated by the accelerating mechanism 28 is introduced into the husking portion 26, comprising the pair of husking rolls 2, 3, without fail by means of a pair of guide plates 22, 23 which are fixed in pairs on the machine frame 4 so that a gap between them becomes narrower as getting closer to the husking portion 26. A guide mechanism 55 constituted by the guide plates 22, 23 may be constructed such that the guide plates 22, 23 are adjustable in position so as to change the magnitude of the gap therebetween.

In this embodiment, a supply mechanism 56 is constituted by the feed tank 6, the opening and closing mechanism 50, the feed mechanism 51, the accelerating mechanism 28 and the guide mechanism 55.

Figure 4:
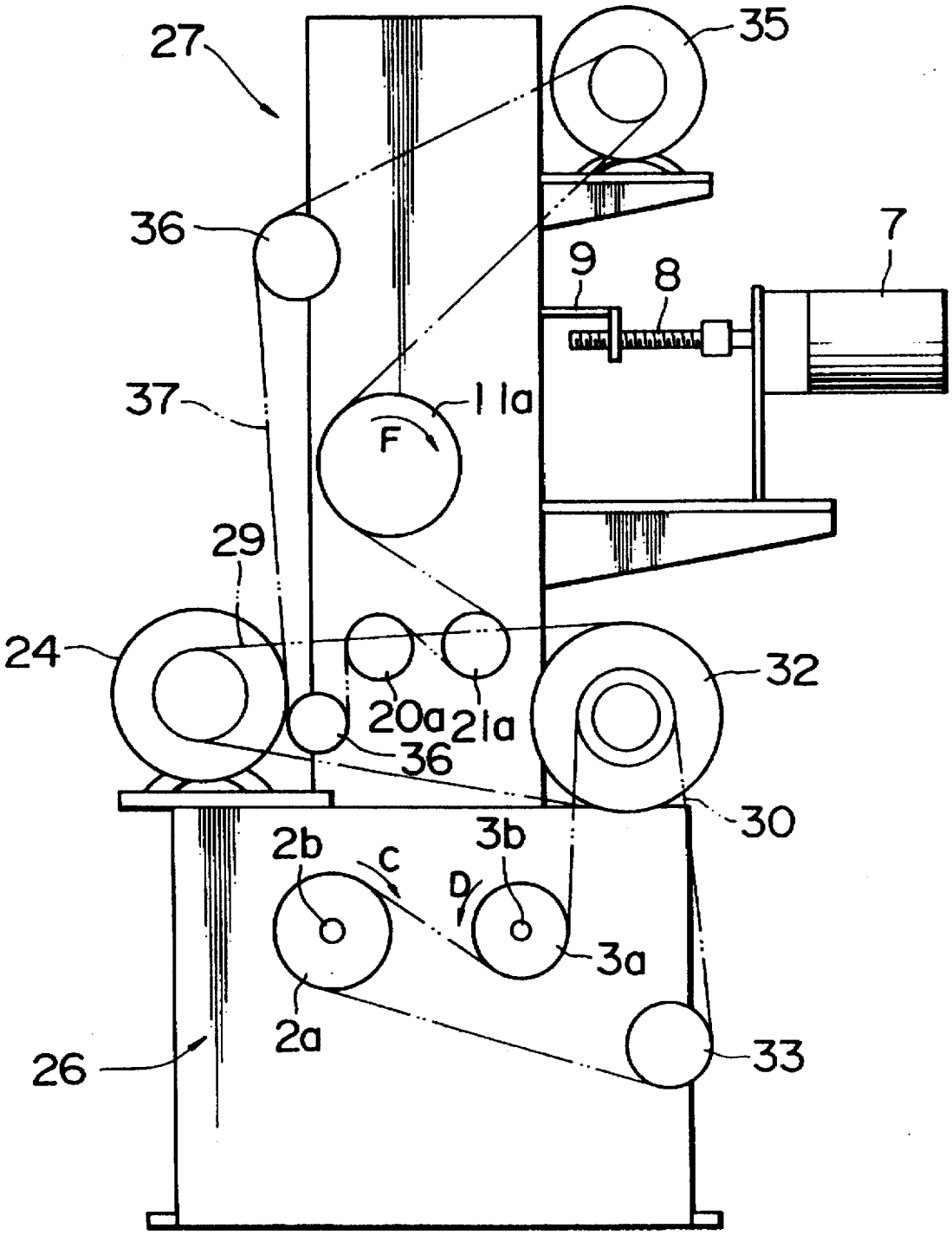
FIG. 4 is a schematic diagram of driving system for the apparatus of FIG. 3.

FIG. 4 shows the details of a driving system for the husking apparatus 25. Referring to an illustration of the driving system of FIG. 4, driving force of a driving motor 24 is transmitted through a belt 29 and an intermediate pulley 32 to the husking portion or the rubber roll device 26 by means of a belt 30. The husking apparatus 25 additionally has another driving motor 35, and driving force of the driving motor 35 is transmitted through a belt 37 to the delivery roll 11 and the high speed rotary rolls 20 and 21 of the accelerating mechanism 28, respectively, through a pulley 11a coaxial with the delivery roll 11 and through pulleys 20a and 21a coaxial with the high speed rotary rolls 20 and 21. Reference numerals 33, 36 denote tension pulleys.

In the husking apparatus 25 thus constructed, as the driving motors 24, 35 are driven to rotate, the rubber rolls 2, 3 of the husking portion 26, the delivery roll 11 of the feed portion 51 and the high speed rotary rolls 20, 21 of the accelerating mechanism 28 are driven to rotate in the predetermined directions. As the small-scale motor 7 is driven to cause the shutter 9 to open, paddy of long-grain variety of rice starts falling from the opening 6a of the feed tank 6 to be supplied to the delivery roll 11 by means of the guide plates 10 and then begins to be sent or discharged downward through the gap B at a fixed flow rate defined by the magnitude or size of the gap B between the delivery roll 11 and the adjusting plate 13 and by the rotational speed of the delivery roll 11. The amount discharged or supplied (per unit time) is regulated or adjusted so that the thickness of the layer of the flow of paddy of long-grain variety of rice becomes not greater than two grains at or around the position between the rubber rolls 2, 3 at a flowing-down speed of the paddy grain to be described later.

The discharged paddy of long-grain variety of rice is sent in between the pair of constant-speed rotary rolls 20, 21 constituting the accelerating mechanism 28 by means of the guide plate 15 and then thrown out downward at high speed with nip and high-speed rotation of the pair of rolls 20, 21. The paddy of long-grain variety of rice having been accelerated by the accelerating mechanism 28 and thrown out downward, is introduced in between the pair of husking rolls 2, 3 of the husking portion 26 without fail by means of the pair of guide plates 22, 23, which are fixed in pairs on the machine frame 4 in such a manner that the gap between them becomes narrower as getting closer to the husking portion 26, with the layer thickness of the flow of paddy of long-grain variety of rice regulated at two grains.

When the paddy grain finally arrives in between the husking rolls 2, 3, the flowing-down speed V of paddy grain has become not less than 3 m/sec. Consequently, the thickness of the layer of the flow of paddy of long-grain variety of rice becomes tow grains as described above. In this way, the requirements for layer thickness and flowing-down speed, with which generation or production of broken grain may be minimized in practice, are satisfied, and therefore it is ensured that the predetermined husking throughput for 10-inch rubber roll can be achieved in the husking apparatus 25.

In the case of this embodiment, the predetermined flowing-down speed is mainly or essentially given by the accelerating mechanism 28, while the predetermined layer thickness is mainly or essentially given by the accelerating mechanism 28 and the guide mechanism 55.

As described above, in the husking apparatus 25 according to the second preferred embodiment of the invention as well, the layer thickness of the flow of paddy of long-grain variety of rice is made thinner than that adopted in recent years on the one hand and the flowing-down speed is increased to compensate the decrement in layer thickness on the other, and therefore it is ensured that husking process can be performed at the predetermined throughput estimated from the size (effective length) of rubber rolls while minimizing the production or generation of broken grain in the husking process.

What is claimed is:

1. A husking apparatus comprising:

a husking portion having a pair of husking rolls which are adjustable in clearance between them and rotated in opposite directions with different peripheral speeds to perform husking of paddy grain; and a supply portion disposed above said husking portion for supplying paddy grain to be husked to said husking portion, wherein said supply portion is so constructed as to supply paddy grain from said supply portion to said husking portion in the form of a layer in such a manner that a thickness of a flow of paddy grain becomes not greater than two grains at said husking portion, and said supply portion is so constructed as to supply paddy grain to the husking portion at a speed not less than a flowing-down speed corresponding to a minimum husking throughput desired of the husking apparatus so that husking is performed with a throughput not less than said minimum husking throughput.

2. A husking apparatus according to claim 1, wherein the flowing-down speed of paddy grain becomes not less than 3 m/sec when said paddy grain reaches the clearance between the pair of husking rolls.

3. A husking apparatus comprising:

a husking portion having a pair of husking rolls which are adjustable in clearance between them and rotated in opposite directions with different peripheral speeds to perform husking; and a supply portion disposed above said husking portion for supplying paddy grain to be husked to said husking portion, wherein said supply portion comprises a feed tank for storing paddy grain, a guide chute mechanism for sending paddy grain from a lower end thereof to the husking portion, said guide chute mechanism having a guide chute on which paddy grain slides down, and a feed portion for guiding the paddy grain falling from an outlet of the feed tank to an upper end of the guide chute in order, a fall from the outlet of said feed tank to the clearance between the husking rolls of the husking portion being not less than 500 mm, and said guide chute being so constructed that a thickness of the layer of the flow of paddy grain thrown out of the lower end of said chute becomes not greater than two grains.

4. A husking apparatus according to claim 3, wherein the flowing-down speed of paddy grain becomes not less than 3 m/sec when said paddy grain reaches the clearance between the pair of husking rolls.

5. A husking apparatus according to claim 3, further comprising an adjusting mechanism for adjusting an inclination of the guide chute to regulate a position of the lower end of said chute according to a change in the position of the clearance between the husking rolls attributed to progress of abrasion of said husking rolls.

6. A husking apparatus comprising:

a husking portion having a pair of husking rolls which are adjustable in clearance between them and rotated in opposite directions with different peripheral speeds to perform husking; and.

a supply portion disposed above said husking portion for supplying paddy grain to be husked to said husking portion, wherein said supply portion comprises a feed tank for storing paddy grain, an accelerating mechanism portion for positively accelerating paddy grain having been dropped from an outlet of the feed tank, and a guide mechanism portion for guiding further fall of paddy grain having been accelerated by said accelerating mechanism portion to send said paddy grain to the husking portion, said accelerating mechanism portion and said guide mechanism portion are so constructed that a thickness of a layer of flow of paddy grain thrown out from a lower end of said guide mechanism portion to be sent to the husking portion in the form of the layer, becomes not greater than two grains at said husking portion, and said supply portion is so constructed as to supply paddy grain to the husking portion at a speed not less than a flowing-down speed corresponding to a minimum husking throughput desired of the husking apparatus so that husking is performed with a throughput not less than said minimum husking throughput.

7. A husking apparatus according to claim 6, wherein said accelerating mechanism portion is constituted by a pair of constant-speed rolls.

8. A husking apparatus according to claim 6, wherein said supply portion is so constructed that the flowing-down speed of paddy grain becomes not less than 3 m/sec when said paddy grain reaches the clearance between said pair of husking rolls.

* * * * *